US007356861B1

(12) United States Patent
Pagano

(10) Patent No.: US 7,356,861 B1
(45) Date of Patent: Apr. 15, 2008

(54) INFANT SUPPORT SEAT CUSHION

(76) Inventor: Paul Pagano, 117 Overhill Rd., Boardman, OH (US) 44512

( * ) Notice: Subject to any disclaimer, the term of this patent is extended or adjusted under 35 U.S.C. 154(b) by 0 days.

(21) Appl. No.: 11/519,593

(22) Filed: Sep. 13, 2006

(51) Int. Cl.
*A47D 1/00* (2006.01)
*A47D 15/00* (2006.01)

(52) U.S. Cl. ..... 5/655; 5/922; 297/464

(58) Field of Classification Search ..... 5/655, 5/630, 632, 922, 653, 654; 297/464
See application file for complete search history.

(56) References Cited

U.S. PATENT DOCUMENTS 1,776,122 A * 9/1930 Benjamin ..... 297/467
3,840,916 A * 10/1974 Jennings ..... 5/655
4,143,915 A * 3/1979 Kamlay ..... 297/488
5,519,906 A 5/1996 Fanto-Chan
5,661,861 A 9/1997 Matthews
6,000,761 A * 12/1999 Rocha ..... 297/464
D450,516 S 11/2001 Darling et al.
D450,517 S 11/2001 Darling et al.
6,684,422 B2 * 2/2004 LeFevre et al. ..... 5/496
6,810,545 B1 11/2004 Darling et al.
6,918,149 B2 * 7/2005 Gowaty ..... 5/655

* cited by examiner

*Primary Examiner*—Alexander Grosz
(74) *Attorney, Agent, or Firm*—Harpman & Harpman

(57) ABSTRACT

An infant support cushion to provide a safe and secure environment for containment and retainment of an infant in a sitting position. The support cushion is provided with a resilient foam cushion body with a child receiving opening centrally therein and a contoured extremity receiving portions defined by an access opening inwardly from its perimeter front edge surface by oppositely disposed extending cushion arm portions. Interlinking fastener elements maintain the arm portions in an engaged closed position maintaining corresponding central opening therewithin and contoured extremity receiving portions for the infant's leg.

5 Claims, 3 Drawing Sheets

INFANT SUPPORT SEAT CUSHION

BACKGROUND OF THE INVENTION

1. Technical Field

This device relates to an infant and child support and stabilization containment cushions that securely confine and support a child in a desired position.

2. Description of Prior Art

Prior art devices of this type have been directed towards cushion configurations oriented to hold or support an infant, caregiver or adults in an engaging manner, see for example U.S. Pat. Nos. 5,519,906, 5,661,861, 6,685,024, 6,810,545 and Design Pat. D450,517 and D540,516.

In U.S. Pat. No. 5,661,861 a support pillow is illustrated that is positioned about the upper torso of a user so that their arms can rest thereon in a sitting position.

U.S. Pat. No. 6,685,024 shows a support pillow and method of use in which a horse shoe shaped pillow is configured defining a circular opening well within. The pillow is positioned around the user's torso with the "arm" portions facing backwards.

U.S. Pat. No. 6,810,545 is directed towards an infant support pillow and method of assembly in which a pillow body has two contoured arms extending from its medial region in spaced parallel relation in a U-shaped form. A toy arch extends between the arms on which interfacing interactive toys are positioned.

Design Pat. D450,517 is on an infant support pillow having a general horseshoe configuration and Design Pat. D540,516 is an ornamental design where the infant support pillow described in U.S. Patent noted above in 545.

SUMMARY OF THE INVENTION

An infant support and entertainment cushion in which a soft resilient contoured body member is defined with an infant receiving opening centrally located therewithin. The support cushion rests on the floor with the infant positioned in a supportive seating position. The cushion access portions are defined by recess affording leg orientation in a sitting position. Toy attachment areas are defined on the surrounding upper surface thereof allowing the infant access to interchangeable toys releasably positioned thereon. Closure restraint strap fasteners secure the access opening about the infant.

DETAILED DESCRIPTION OF THE INVENTION

Figure 1:
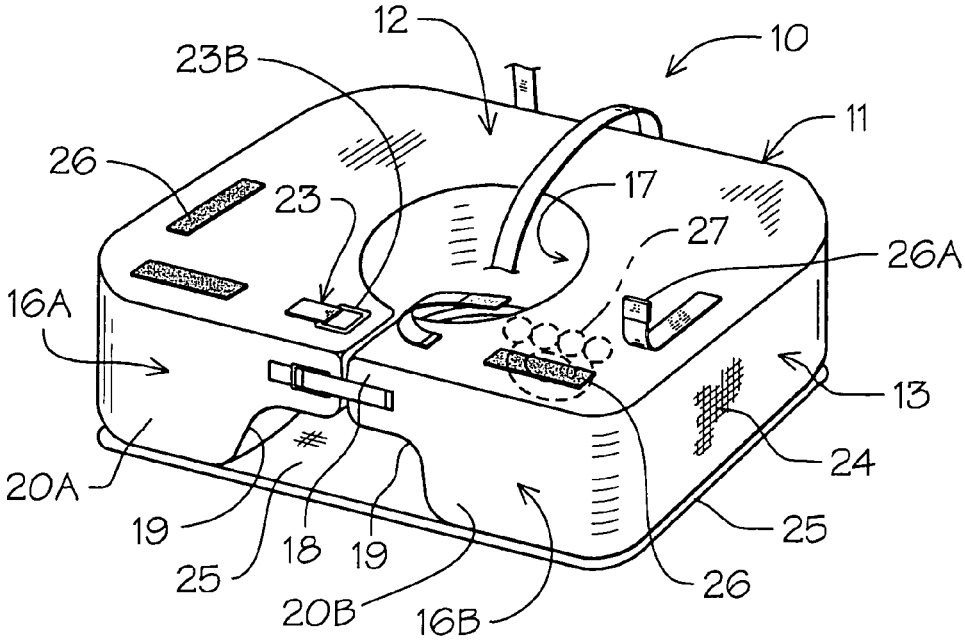
FIG. 1 is a perspective view of the infant support cushion of the invention.
Figure 4:
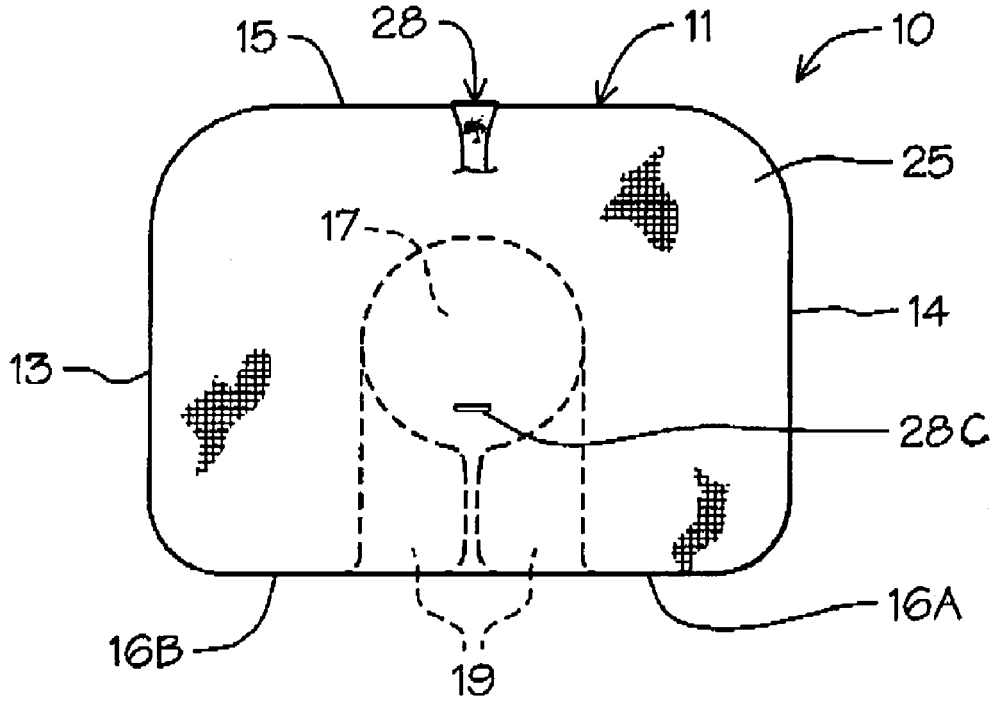
FIG. 4 is a bottom plan view thereof.

Referring to FIGS. 1-5 of the drawings, an infant support cushion 10 of the invention can be seen having a main monolithic body member 11 of a generally overall rectangular configuration with an upper flat surface 12 and oppositely disposed parallel depending sidewalls 13 and 14 and integral interconnected back sidewall 15. Front depending walls 16A and 16B define an access opening therewithin extending to and in communication with a central circular opening at 17 extending vertically through the main body member 11. An intermediate cushion portion 18 extends between the front walls 16A and 16B and the central circular opening at 17 and is contoured along its respective surfaces 19 defining effacing arm portions 20A and 20B as best seen in FIGS. 1 and 4 of the drawings as recesses in the front wall 16A and 16B and associated bottom engagement surfaces 21A and 21B.

Figure 5:
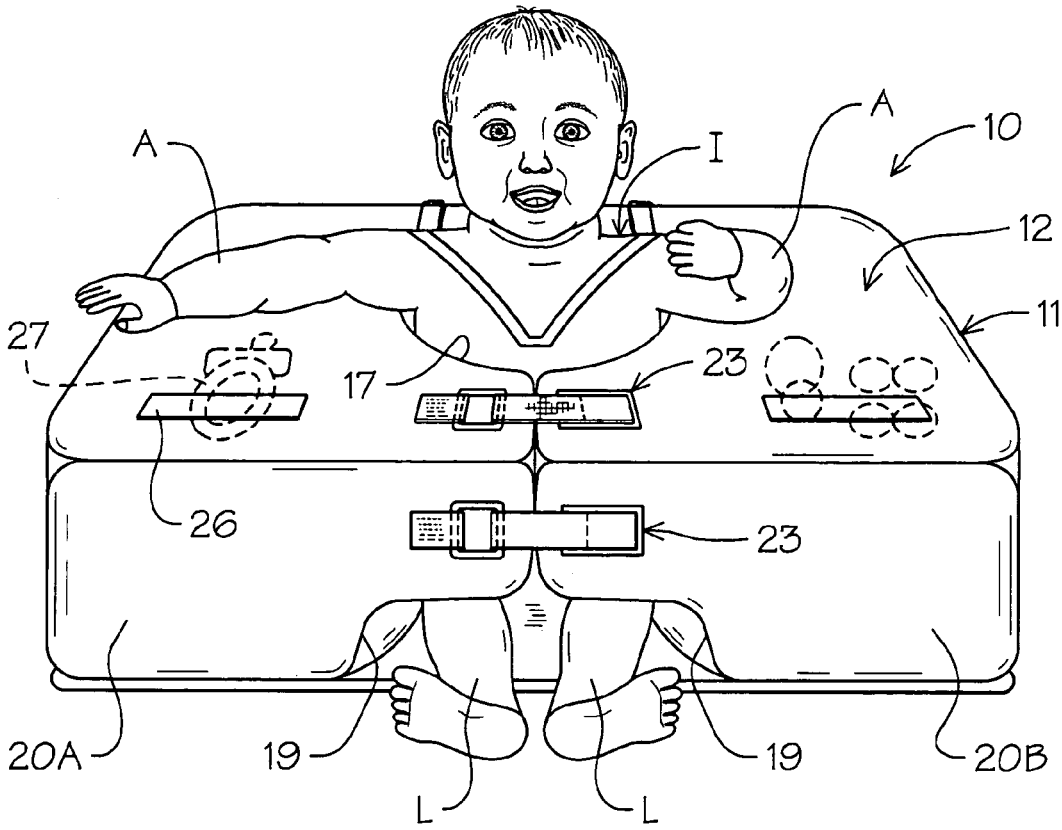
FIG. 5 is a front perspective view in use with an infant representation positioned therewithin.

The arm portions 20A and 20B have abutting free edge surfaces 22A and 22B when not deflected apart as required for positioning an infant E, see in FIG. 5 of the drawings within a sitting position in the central opening at 17 during use.

It will be evident that the circular central opening at 17 will therefore selectively receive the infant I with the infant's legs L in a sitting position extending outwardly through the corresponding space defined by the respective contoured surfaces 19 as hereinbefore described.

The infant's arms A will be above the upper surface 12 of the main body member 11 allowing for free use thereof as desired. Multiple fastening strap assemblies 23 are secured to the top surface 12 and front walls 16A and 16B of the respective arm portions 20A and 20B so as to selectively registerably engage one another maintaining their respective arm portions 20A and 20B in an adjoining use configuration.

The fastening strap assemblies 23 are comprised of a strap portion 23A with a hook and loop fabric segments which are secured in longitudinally aligned overlapping return configuration through a loop 23B on the respective oppositely disposed arm portions 20A and 20B upper surface 12 and front wall 16A and 16B surfaces for adjustability so as to be registerably engaged during use, as best seen in FIGS. 1, 2, 3 and 5 of the drawings.

The main body member 11 has a tailored cover 24 of cloth material or synthetic equivalent with an access opening closure 24A over a corresponding contoured synthetic foam sponge material infilled therewith. A rigid base panel 25 of a corresponding bottom configuration, best seen is FIG. 4 of the drawings is attached thereto. Such attached molded foam is of a shape retaining density sufficient to provide yield of support to the infant I positioned within the central opening 17 of the cushion 10 of the invention.

Multiple toy attachment surface engagement areas 26 and 26A are attached on the upper top surface 12 for a permanent or removable secure attachment of infant interest toys 27, well known to those skilled in the art. Such engagement areas 26 are preferably of a loop material of hook and loop fastening elements to registerably engage corresponding hook materials positioned on the respective infant toys 27 which are shown for illustration purposes as a representative in broken lines. Alternate interengaging clip attachment areas 26A are also provided The dimensions of the infant support cushions 10 are such as to provide adjustable engagement with the infant I within a certain early age group associated with primary motor skill development such as sitting. The cushion configuration 10 of the invention will also serve as a comfortable confinement placement device assuring a safe and stable entertainment upright environment for the infant and affording a hands off orientation action for the parents or caregiver, not shown.

The dimensional aspects of the infant cushion 10 of the invention is defined by the height of the main body member being such that the infant I's arms A will always be above the surface 12 allowing for easy access to the hereinbefore described infant toys 27 positioned thereon. Giving the resilient sponge nature of the infilled foam material, as noted, the infant I can turn and twist providing a corresponding movement range while in the sitting position which is maintained and supported by the effective surface engagement of the cushion centralized field within the opening 17 against the infant's torso.

Figure 2:
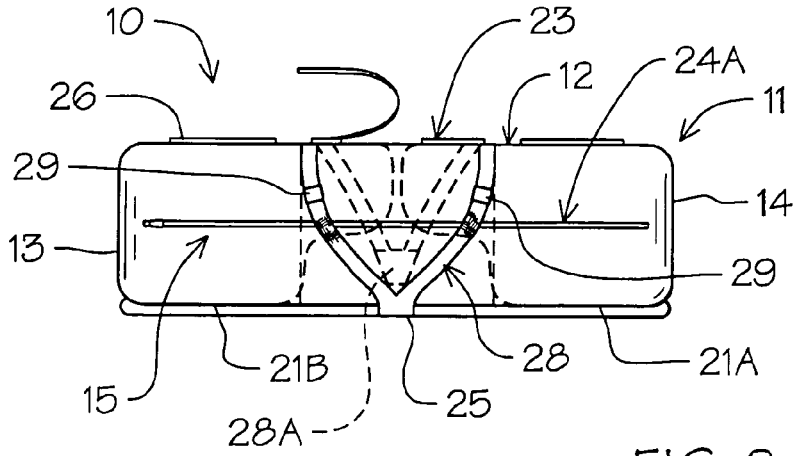
FIG. 2 is a rear elevational view thereof.
Figure 3:
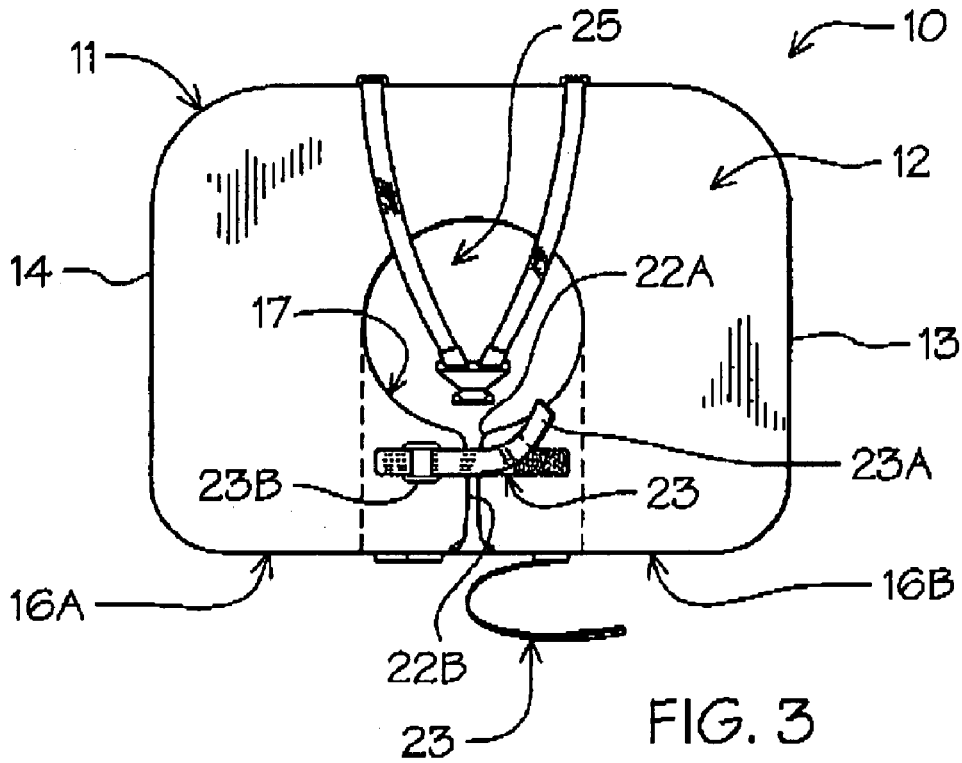
FIG. 3 is a top plan view thereof.

An infant containment strap harness assembly 28, best seen in FIG. 2 of the drawings has a crotch engagement plate 28A with a pair of straps extend from within the central opening 17 so as to loop out over the infant I then across the respective upper surfaces 12 and down the back sidewall 15 terminating in respective inter-registration clips 29. An access slot 28C is provided in the base panel 25 for the harness assembly 28.

It will thus be seen that a new and novel infant support cushion and entertainment device has been illustrated and described and it will be apparent to those skilled in the art that various changes and modifications may be made thereto without departing from the spirit of the invention.

Therefore I claim:

1. A support device for an infant in a sitting position comprises, a generally rectangular shaped cushion configuration having a top surface with depending sides, front and rear wall surfaces therefrom, a central infant receiving opening within said top surface, a pair of similar configured arm portions formed from within the cushion in corresponding abutting relationship to one another, contoured recess areas on portions of said respective arm portions defining an infant appendage passageway in said front wall portion in communication with said central infant receiving opening, fastener engagement means on said arm portions for selectively maintaining said arm portions registration contact with one another, an infant containment strap harness comprising a pair of straps extending from a central plate within said infant receiving opening, said straps extend over said infant and said rear wall surfaces, a rigid base panel interengaged on its bottom ground engaging surface, secure placement means on said top surface of said cushion about said central opening therewithin for receiving elective toys in engagement thereon.

2. The support device for an infant in a sitting position set forth in claim 1 wherein said cushion has a removable form fitting cover thereon.

3. The support device for an infant in a sitting position set forth in claim 1 wherein said contoured recessed areas of said respective arm portions are in spaced relation to said top surface.

4. The support device for an infant in a sitting position set forth in claim 1 wherein said infant appendage passageway provides an opening for infant's legs in a sitting position.

5. The support device for an infant in a sitting position set forth in claim 1 wherein said fastener engagement means on said arm portions comprises, hook and loop fabric in selective releasable interengagement registration on respective arm portions for cross registration therewith.

* * * * *